US010764699B1

(12) United States Patent
Rule

(10) Patent No.: US 10,764,699 B1
(45) Date of Patent: Sep. 1, 2020

(54) MANAGING CHARACTERISTICS OF EARPIECES USING CONTROLLED CALIBRATION

(71) Applicant: Bose Corporation, Framingham, MA (US)

(72) Inventor: John Rule, Framingham, MA (US)

( * ) Notice: Subject to any disclaimer, the term of this patent is extended or adjusted under 35 U.S.C. 154(b) by 0 days.

(21) Appl. No.: 16/537,018

(22) Filed: Aug. 9, 2019

(51) Int. Cl.

| | |
|---|---|
| ***H04R 1/02*** | (2006.01) |
| ***H04R 1/10*** | (2006.01) |
| ***H04R 29/00*** | (2006.01) |
| ***G10K 11/16*** | (2006.01) |
| ***H04R 3/00*** | (2006.01) |
| ***G10K 11/178*** | (2006.01) |

(52) U.S. Cl.
CPC ..... *H04R 29/001* (2013.01); *G10K 11/17823* (2018.01); *H04R 1/02* (2013.01); *H04R 1/1016* (2013.01); *H04R 1/1025* (2013.01); *H04R 1/1041* (2013.01); *G10K 2210/1081* (2013.01); *G10K 2210/3026* (2013.01); *G10K 2210/3027* (2013.01); *H04R 2420/07* (2013.01)

(58) Field of Classification Search
CPC ..... H04R 1/02; H04R 1/10; H04R 1/1016; H04R 1/1025; H04R 1/1041; H04R 1/1083; H04R 3/00; H04R 29/00; H04R 29/001; H04R 29/004; H04R 2420/07; G01K 11/16; G01K 11/18; G01K 11/22; G01K 11/175; G01K 11/178; G01K 11/17823; G10K 2210/1081; G10K 2210/3026; G10K 2210/3027
See application file for complete search history.

(56) References Cited

U.S. PATENT DOCUMENTS

| | | | | |
|---|---|---|---|---|
| 9,148,717 | B2 | 9/2015 | Shaffer | |
| 9,161,118 | B2 | 10/2015 | Howes et al. | |
| 9,438,992 | B2 | 9/2016 | Every et al. | |
| 9,854,344 | B2 | 12/2017 | Cheney et al. | |
| 10,136,222 | B2 | 11/2018 | Hayashi et al. | |
| 2004/0264706 | A1 | 12/2004 | Ray et al. | |
| 2013/0148839 | A1* | 6/2013 | Stevinson | H04R 1/1033 381/384 |
| 2013/0208908 | A1 | 8/2013 | Theiler et al. | |
| 2014/0294193 | A1* | 10/2014 | Tikander | H04R 3/02 381/74 |
| 2016/0066822 | A1* | 3/2016 | Shennib | A61B 5/123 600/559 |
| 2016/0073189 | A1* | 3/2016 | Linden | H04R 1/1025 381/74 |
| 2017/0094394 | A1 | 3/2017 | McPeak et al. | |
| 2017/0094397 | A1* | 3/2017 | Wagman | H01R 13/521 |

(Continued)

*Primary Examiner* — Thang V Tran
(74) *Attorney, Agent, or Firm* — Young Basile Hanlon & MacFarlane, P.C.

(57) ABSTRACT

An audio system comprises: a first earpiece comprising at least one acoustic driver, and circuitry that comprises at least one microphone; a housing configured to receive the first earpiece and enclose around the first earpiece; an acoustic cavity within the housing configured to provide a predetermined volume that is acoustically coupled to the acoustic driver when the first earpiece is housed within the housing. The first earpiece or the housing comprises circuitry configured to: (1) measure a response from the microphone to an acoustic wave, and (2) calibrate the circuitry based at least in part on the measured response.

19 Claims, 6 Drawing Sheets

(56) References Cited

U.S. PATENT DOCUMENTS

| | | | | |
|---|---|---|---|---|
| 2017/0245045 | A1 | 8/2017 | Horbach | |
| 2018/0064224 | A1* | 3/2018 | Brzezinski | A45C 11/24 |
| 2018/0091887 | A1* | 3/2018 | Minoo | H02J 7/0044 |
| 2019/0327550 | A1* | 10/2019 | Linden | H04R 11/02 |

* cited by examiner

MANAGING CHARACTERISTICS OF EARPIECES USING CONTROLLED CALIBRATION

TECHNICAL FIELD

This disclosure relates to managing characteristics of earpieces using controlled calibration.

BACKGROUND

The earpieces of earphones or other audio or multimedia devices configured to be worn by a user, such as separate (e.g., left and right side) wireless or wired earbuds, or earpieces of headphones, may include components such as an acoustic driver that generates a sound wave to be heard by the user, and one or more microphones. For example, for earphones that use active noise reduction, the microphones within an earpiece may include one or more feedback microphones that detect sound within a controlled acoustic environment as part of a feedback loop, and one or more feedforward microphones that detect noise external the controlled acoustic environment to further aid in noise reduction. The (unknown) sensitivity of the microphones may be calibrated using testing procedures performed during manufacture of the earphones. For example, earphones may be placed on an "artificial head" that includes microphones having a known sensitivity inside "artificial ears" to measure the level of a test audio signal that arrives at the artificial ear when an active noise reduction function of the earpieces is being tested.

SUMMARY

In one aspect, in general, an audio system comprises: a first earpiece comprising at least one acoustic driver, and circuitry that comprises at least one microphone; a housing configured to receive the first earpiece and enclose around the first earpiece; an acoustic cavity within the housing configured to provide a predetermined volume that is acoustically coupled to the acoustic driver when the first earpiece is housed within the housing. The first earpiece or the housing comprises circuitry configured to: (1) measure a response from the microphone to an acoustic wave, and (2) calibrate the circuitry based at least in part on the measured response.

Aspects can include one or more of the following features.

The acoustic wave is provided by the acoustic driver in the first earpiece.

The circuitry comprises active noise reduction circuitry, and the microphone comprises a feedback microphone in a feedback signal path of the active noise reduction circuitry.

The audio system further comprises a second earpiece that includes at least one acoustic driver.

The acoustic wave is provided by the acoustic driver in the second earpiece.

The circuitry comprises active noise reduction circuitry, and the microphone comprises a feed-forward microphone in a feed-forward signal path of the active noise reduction circuitry.

The housing is configured to include an acoustic passage that acoustically couples the acoustic driver in the second earpiece to the microphone when the first earpiece and the second earpiece are housed within the housing.

Calibrating the circuitry based at least in part on the measured response comprises calibrating a gain associated with the microphone based at least in part on the measured response.

Calibrating the gain associated with the microphone comprises calibrating a gain setting in a signal path that provides a signal derived from the microphone.

The housing comprises a case that includes a receptacle configured to receive the first earpiece.

The first earpiece comprises a portion of a wearable audio device, where the earpiece is configured to be placed in, on, around, or in proximity to at least a portion of an ear.

The case comprises charging circuitry that is configured to charge a battery in a portion of the wearable audio device.

In another aspect, in general, a method for calibrating wearable audio devices comprises: providing a first signal to generate a first acoustic wave from an acoustic driver in a first earpiece; measuring a response from a microphone in a second earpiece to the first acoustic wave; calibrating circuitry in the first earpiece based at least in part on the measured response from the microphone in the second earpiece; providing a second signal to generate a second acoustic wave from an acoustic driver in the second earpiece; measuring a response from a microphone in the first earpiece to the second acoustic wave; and calibrating circuitry in the second earpiece based at least in part on the measured response from the microphone in the first earpiece.

Aspects can include one or more of the following features.

Calibrating the circuitry in the first earpiece comprises calibrating the circuitry in the first earpiece based at least in part on the measured response from the microphone in the second earpiece and based at least in part on the measured response from the microphone in the first earpiece.

Calibrating circuitry in the second earpiece comprises calibrating the circuitry in the second earpiece based at least in part on the measured response from the microphone in the first earpiece and based at least in part on the measured response from the microphone in the second earpiece.

In another aspect, in general, a case for a wearable audio device comprises: a housing configured to receive a first earpiece in a first portion of the housing and configured to receive a second earpiece in a second portion of the housing; and an acoustic cavity within the housing configured to provide a predetermined volume that is acoustically coupled to the first portion of the housing and to the second portion of the housing.

Aspects can include one or more of the following features.

The case further comprises charging circuitry that is configured to recharge batteries within the first and second earpieces.

The case further comprises a battery coupled to the charging circuitry that supplies power to recharge the batteries within the first and second earpieces.

The case further comprises an acoustic passage configured to acoustically couple an acoustic driver in the first earpiece to a microphone in the second earpiece.

The case further comprises an acoustic passage configured to acoustically couple an acoustic driver in the second earpiece to a microphone in the first earpiece.

Aspects can have one or more of the following advantages.

Characteristics of earbuds or the earpieces of headphones and other wearable audio devices, such as sensitivities of the microphones within different earpieces, may vary over a relatively wide range due to manufacturing variations. Even if earpieces have been tested during manufacture to ensure their circuitry (e.g., including embedded microphones) has been properly calibrated, there may be reasons why certain characteristics of an earpiece may deviate from an optimum configuration over time. The sensitivity of a particular microphone may vary over time, for example, due to exposure to environmental conditions such as humidity or temperature, or simply due to aging. The sensitivity may be defined as the ratio between the electrical voltage generated (e.g., measured in units of Volts (V)) and the sound pressure level (e.g., measured in units of pressure, called Pascals (Pa)) of an acoustic wave incident on the microphone, yielding a sensitivity in units of V/Pa (or similar units with a different quantitative factor, such as mV/Pa). Each microphone can have an associated trim control to adjust the effective gain to compensate for the sensitivity. If the measured sensitivity is lower than expected, the trim control can be used to increase the effective gain, or if the measured sensitivity is higher than expected, the trim control can be used to decrease the effective gain. Similarly, an acoustic driver can also have an associated sensitivity that can be compensated for variation over time.

In the factory, there is typically a fixture that secures the position and orientation of the earpiece relative to an acoustic environment provided by an acoustic cavity that is part of the fixture. However, when earpieces are in the possession of a user, the acoustic environment surrounding the earpieces, which may be dominated by a near-field acoustic environment, is not generally known. A case that houses the earpieces when they are not in-use (e.g., a charging case for wired or wireless earbuds, headphones, or other wearable audio devices) is able to provide a stable, repeatable, controlled acoustic environment in which the calibration procedures described herein can be performed. Even if the case is a carrying case but not a charging case, the case can still be configured to engage with the earpieces in a stable configuration relative to the acoustic cavity to provide a relatively stable acoustic environment, and in particular a well-defined near-field acoustic environment.

The calibration techniques described herein can be used to perform repeated checks of those characteristics, and to perform any adjustments that may be appropriate. For example, the response of a microphone in an earpiece to an acoustic wave generated by a driver in the earpiece may change slowly over time as the sensitivity of the microphone changes. Other changes to the response may occur when portions of an earpiece become damaged or worn down over time. For example, ports can be plugged or obstructed due to build-up of dust or debris, or a housing that is part of an acoustic environment around a microphone may be cracked or eroded. A mechanical component that should form a seal may lose its seal, or a mechanical component that should provide an opening may be completely or partially blocked. A performance/health check of an earpiece may be able to characterize and compensate for such issues by performing the calibration procedures described herein. The performance/health check can be initiated in response to detecting a potential issue, and/or at regular intervals or on-demand even if no potential issue is detected. In addition to optimizing the performance of each earpiece, the two earpieces (e.g., for the left ear and the right ear) can be balanced to provide matched experience for each ear, or balanced according to a user's preferences.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1A:
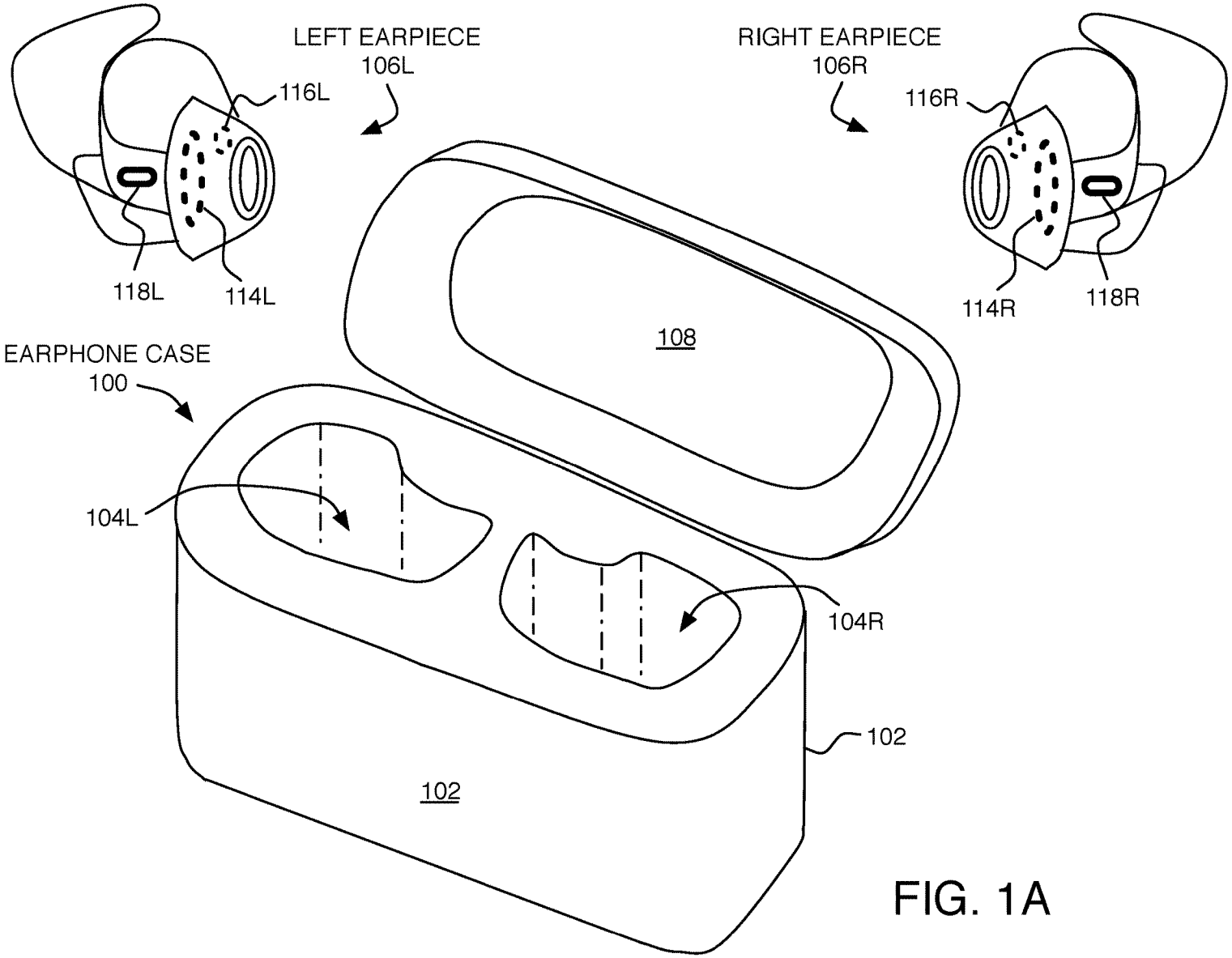
FIG. 1A is an illustration of earpieces with a case that includes an acoustic cavity for calibration.
Figure 1B:
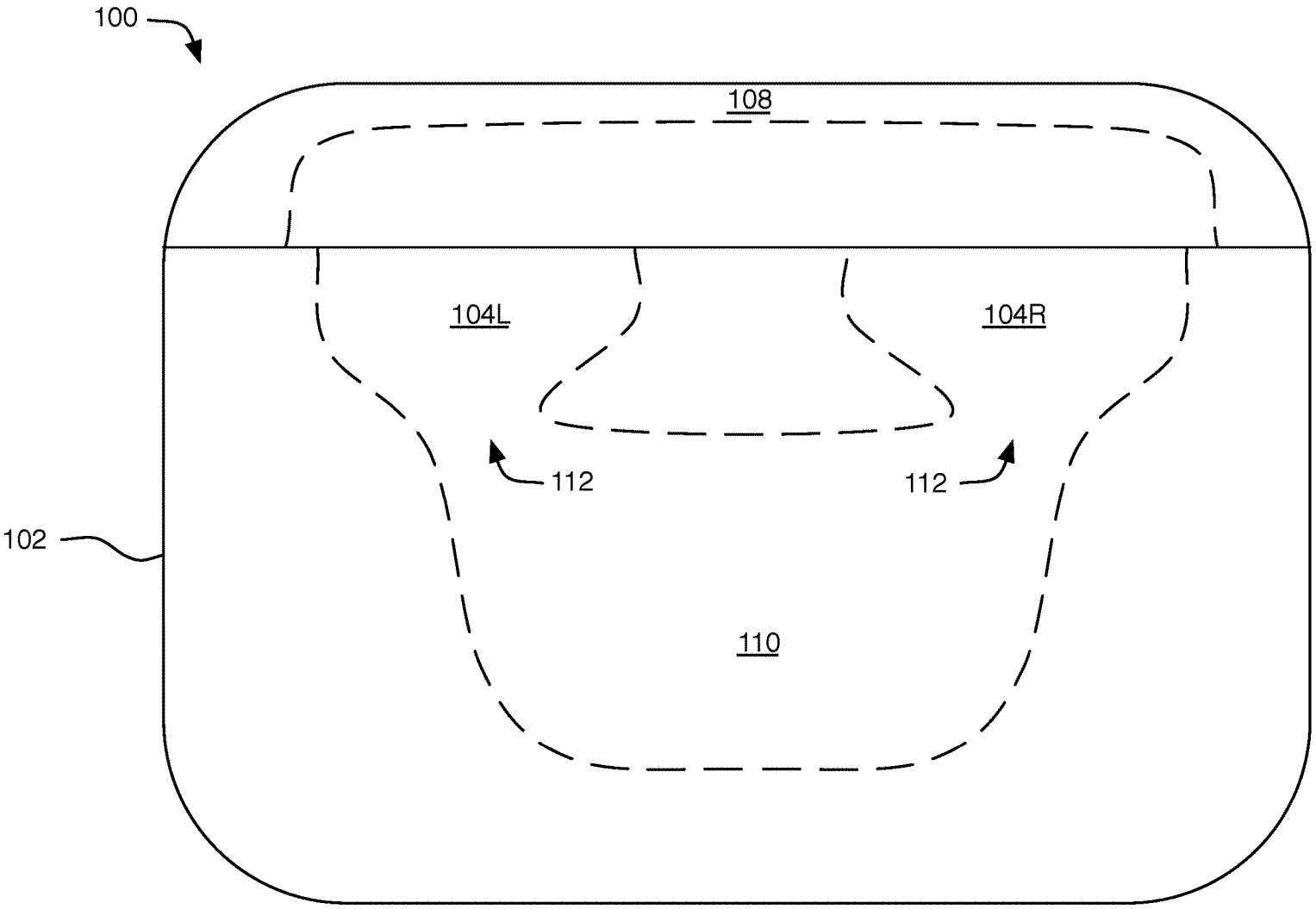
FIGS. 1B-1D are cross-sectional views of earpieces seated within a case and acoustically coupled by an acoustic cavity.

Referring to FIGS. 1A and 1B, an example of an earphone case 100 includes a housing 102 that includes a left receptacle 104L configured to receive a left earpiece 106L and a right receptacle 104R configured to receive a right earpiece 106R. The case 100 also includes a cover 108 that is configured to close over the earpieces 106L and 106R (collectively referred to as earpieces 106) when they are seated within the receptacles 104L and 104R (collectively referred to as receptacles 104). The housing 102 also includes an acoustic cavity 110 (FIG. 1B) that is configured to provide a predetermined volume that is acoustically coupled to each of the earpieces 106 through openings 112 in the acoustic cavity 110. The seal between the cover 108 and the housing 102 is not necessarily airtight, but the cover 108 may facilitate providing a controlled acoustic environment within the acoustic cavity 110. The surface of the acoustic cavity 110 can be formed using a relatively rigid material that provides relatively high reflection and/or relatively low absorption of acoustic waves over an operating spectrum (e.g., frequencies between about 20 Hz and about 20 kHz).

In this example, the earpieces 106 include circuitry for providing high quality sound reproduction with active noise reduction (ANR). Each earpiece includes an acoustic driver 114L (in earpiece 106L) and 114R (in earpiece 106R). Each earpiece also includes a feedback microphone 116L (in earpiece 106L) and 116R (in earpiece 106R), and a feedforward microphone 118L (in earpiece 106L) and 118R (in earpiece 106R). The acoustic drivers 114 (including an acoustic driver 114L in earpiece 106L and an acoustic driver 114R in earpiece 106R) are acoustically coupled to the acoustic cavity 110 through the openings 112 so that a predetermined driver signal (e.g., an electrical signal having a voltage that varies according to predetermined spectrum) produces acoustic waves within the acoustic cavity 110 used for calibrating the microphones. The earpieces 106 are also acoustically coupled to each other, such that an acoustic wave generated by the acoustic driver 114L provides a particular sound pressure level at both the feedback microphone 116L and the feedback microphone 116R, and the acoustic wave generated by the acoustic driver 114R provides a particular sound pressure level at both the feedback microphone 116R and the feedback microphone 116L. This cross-coupling will facilitate the calibration procedures, as described in more detail below.

While FIG. 1A shows earbuds as the right and left earpieces, it should be understood that the calibration techniques described herein are applicable to other types of wearable audio devices. The term "wearable audio device", as used in this document, is intended to mean a device that fits around, on, in, or near an ear (including open-ear audio devices worn on the head or shoulders of a user) and that radiates acoustic energy into or towards the ear. Wearable audio devices are sometimes referred to as headphones, earphones, earpieces, headsets, earbuds or sport headphones, and can be wired or wireless. A wearable audio device includes an acoustic driver to transduce audio signals to acoustic energy. The acoustic driver may be housed in an earpiece. A wearable audio device may include components for wirelessly receiving audio signals. In some examples, a wearable audio device may be an open-ear device that includes an acoustic driver to radiate acoustic energy towards the ear while leaving the ear open to its environment and surroundings.

Figure 1C:
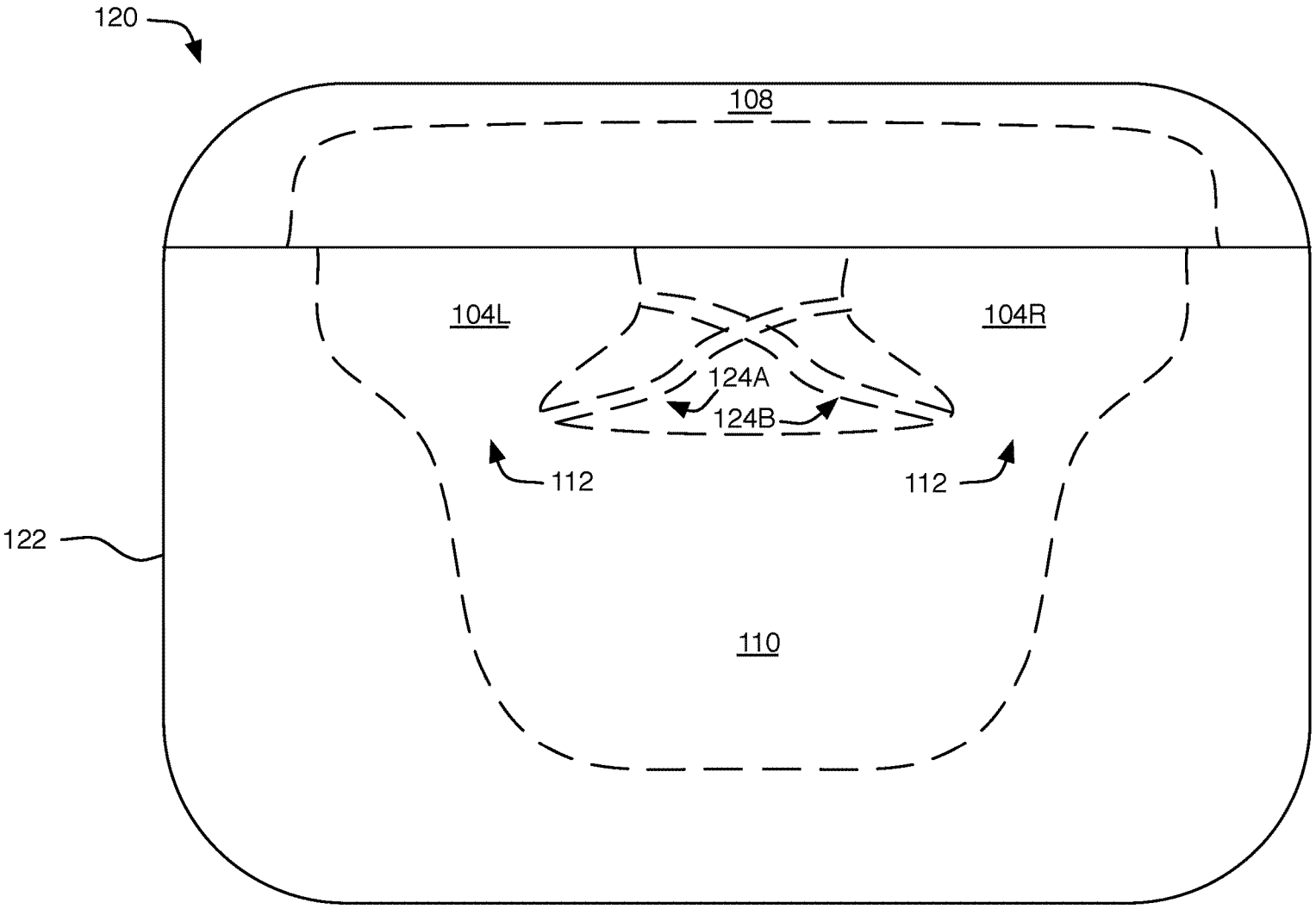

FIG. 1C shows an alternative configuration for an earphone case 120 with a housing 122 that includes the receptacles 104, and the acoustic cavity 110 with openings 112. Additionally, the housing 122 also includes acoustic passages 124A, 124B that provide a way for acoustic waves to propagate from an acoustic driver of one earpiece to the feed-forward microphone of the other earpiece, as described in more detail below. These acoustic passages 124A, 125B may be useful, for example, for measuring and calibrating the feed-forward microphones in an acoustic environment that is similar to the acoustic environment that would be encountered during use of the ANR circuitry. In other examples, a case is configured to house a wearable audio device other than earphones, and may include different arrangement of the acoustic cavity 110 and/or the acoustic passages 124A, 124B, so that they conform to a shape of the wearable device, for example, or couple different components within the wearable audio device, such as drivers and/or microphones located on different portions of the wearable audio device.

Figure 1D:
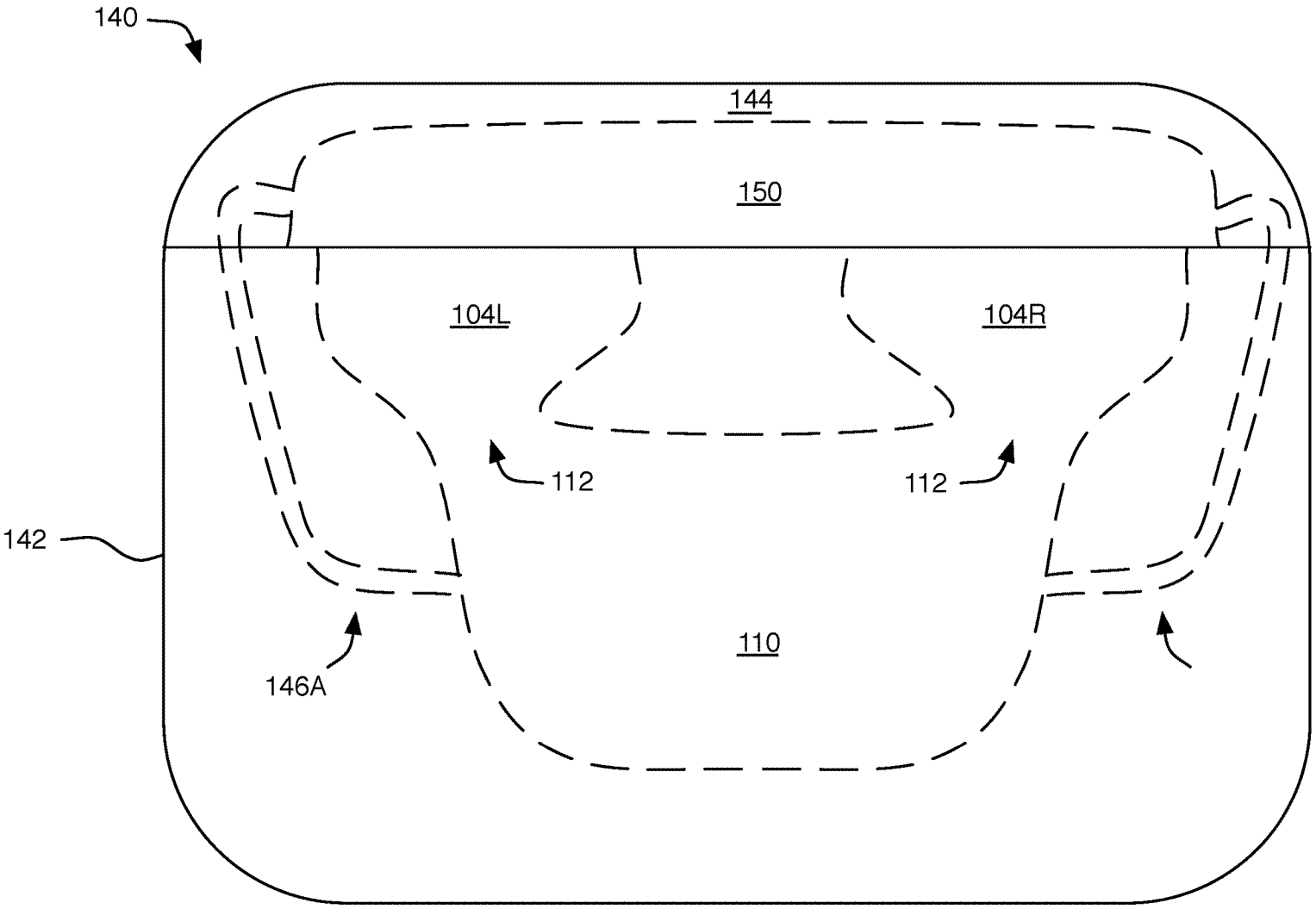

FIG. 1D shows another alternative configuration for an earphone case 140 with a housing 142 that includes the receptacles 104, and the acoustic cavity 110 with openings 112. Additionally, the housing 142 and its cover 144 include acoustic passages 146A, 146B so that the acoustic cavity 110 is acoustically coupled to an upper acoustic cavity 150 when the cover 144 is closed. When the cover 144 is open, there is no longer any coupling to the upper acoustic cavity 150. The acoustic passages 146A, 146B provide an acoustic effect that is similar to what would be provided by an ear canal when the cover 144 is open, while allowing sound to be directed to feed-forward microphones when the cover 144 is closed.

The acoustic cavity 110 in each of the configurations enables the acoustic waves that are produced to form a controlled near-field acoustic environment in which a response from the feedback microphones 116 and/or feed-forward microphones 118 can be measured and used to calibrate the ANR circuitry, which may include the feedback microphones 116 and/or feed-forward microphones 118 and/or additional circuitry. The ANR circuitry is able to provide improved ANR functionality when the effective gain has been calibrated based on measured sensitivities of the microphones in a controlled and known acoustic environment. For example, after calibration, an earpiece that includes ANR is able to more accurately sense the noise in an ear canal using the feedback microphone and/or the noise impinging from outside the earpiece using the feed-forward microphone. While this example includes a single feedback microphone and a single feed-forward microphone for each earpiece, in other examples, additional feedback microphones and/or feed-forward microphones can be used. The ANR circuitry can be included in the earpieces (e.g., for wireless earbuds), and/or in a wired control module (e.g., for wired earbuds), and the circuitry can be configured as described, for example, in U.S. Patent Publication No. 2013/0315412, and U.S. Patent Publication No. 2016/0267899, each of which is incorporated herein by reference in its entirety.

In some implementations, the earphone case is configured as a charging case that engages each earpiece to an electrical terminal that supplies power for charging batteries within the earpieces. The earphone case is configured so that when an earpiece is properly seated within its receptacle, the earpiece makes contact with an electrical terminal (e.g., a pair of metal nubs) to enable a current flow to charge a battery in that earpiece. For example, the case may have a battery of its own used to charge the earpiece batteries, and the case may include a terminal for charging the case in the battery. In the charging configuration, the earpiece is also in a predetermined position and orientation with respect to the acoustic cavity within the case. When the calibration procedures are performed in this configuration, the sensitivity of the microphones in the earpieces, and other characteristics that affect the overall acoustic response, can be measured in an acoustic environment that is dominated by the characteristics of that acoustic cavity.

The characteristics of the acoustic cavity, and of the surrounding case, can all be configured to provide acoustic properties that produce a desired acoustic response. For example, in some implementations, the acoustic cavity may be designed to approximate characteristics (e.g., shape and volume) of an ear canal or of an acoustic cavity of a factory calibration fixture. At low frequencies, the shape of the acoustic cavity may not have a significant impact on the measurements. But, when the diameter of the acoustic cavity is comparable to a characteristic length on the order of a wavelength at a particular acoustic frequency (e.g., a quarter wavelength), the shape of the acoustic cavity may have a measurable impact. But, even if the shape of the acoustic cavity is different from the shape of a human ear canal, or different from the shape of a factory tuning fixture, the effect of the shape on the measurement is stable and predictable as long as the shape of the acoustic cavity is relatively fixed. The cavity could be designed to have a volume close to the volume of a typical ear canal (e.g., around 2 cubic centimeters), but deviations in volume can also be accounted for. Other characteristics, such as the material forming the surface of the acoustic cavity, can also be selected to provide an acoustic response that approximates the response associated with an ear canal or with an acoustic cavity of a factory calibration fixture. Even if the exact acoustic response detected by the microphones during use through an ear canal is different from the acoustic response detected by the microphones during calibration, compensating for changes the "calibration response" may also compensate for changes in the "in-use response."

The spectrum of a calibration driving signal that is used to form the acoustic waves generated by the driver during calibration can be predetermined. For example, a relatively broadband "pink noise" spectrum (i.e., relatively flat over the operating spectrum) may be used to provide a calibration that is relatively insensitive to certain effects. Even when a scalar microphone sensitivity level is being measured (e.g., as opposed to a frequency-dependent frequency response), the broadband calibration driving signal may be able to average out changes in an earpiece that have a significant effect on the response only over one or more narrowband portions of the spectrum. Alternatively, a narrowband calibration driving signal may be used, for example, if there is a particular portion of the spectrum that is expected to be relatively insensitive to frequency-dependent changes in response over time. This type of frequency independence is effective since the changes that are being measured and calibrated are dominated by changes in microphone sensitivity, which is relatively constant over the operating spectrum.

FIGS. 2A-2D show examples of different calibration procedures performed by control modules within the earpieces. In some implementations, one control module in one earpiece is designated as a leader control module and another control module in the other earpiece is designated as a non-leader control module. The leader may communicate with the non-leader to perform certain steps at certain times, and may receive result information from the non-leader (e.g., measured microphone voltage readings) to perform the overall computations in the leader control module. In some implementations, the procedures performed by each control module is configurable by instructions that may be initially loaded at the time of fabrication, and may be updated by transmitting modified instructions into a memory storage device within one or both earpieces (e.g., as a firmware update). The earpieces may be in communication with a user's device (e.g., a smartphone or music player), and an application on the device may be able to provide a graphical user interface for the user to receive alerts and interact with functions and settings, including parameter values that affect the calibration procedures. A wireless pairing procedure may be used to establish communication between the earpieces and the user's device.

Figure 2A:
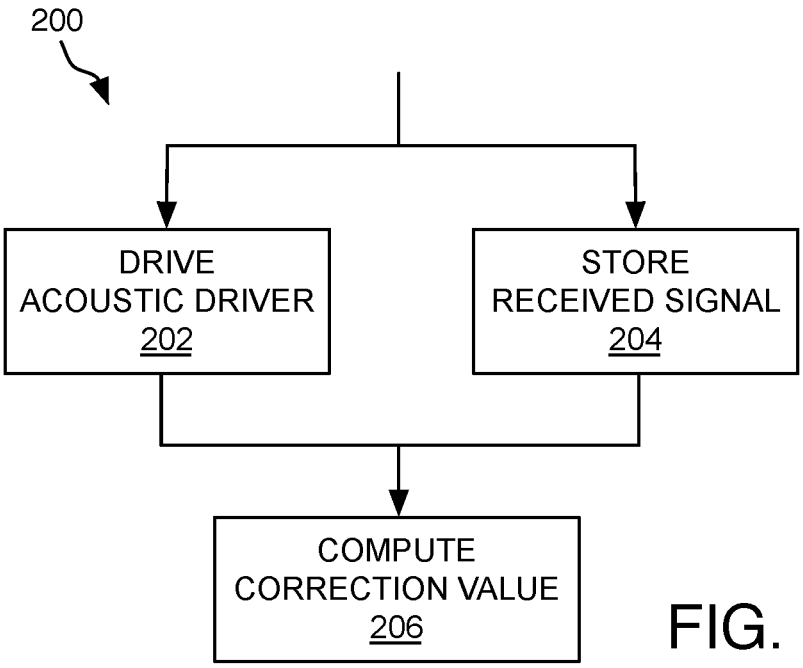
FIGS. 2A-2C are flowcharts for example procedures for calibrating earpieces.

FIG. 2A shows a flowchart for an example procedure 200 for calibrating a feedback microphone of an earpiece in a case. In this example, while both earpieces may be seated within their respective receptacles to provide a well-defined acoustic environment, a single one of the earpieces (e.g., the right earpiece 106R) is able to perform the procedure 200 to calibrate its own feedback microphone. The control module in the earpiece 106R drives (202) its acoustic driver 114R with a predetermined driving signal (e.g., an audio signal that has a spectrum with one or more tones, or broadband spectral content, for a predetermined amount of time). While the acoustic driver 114R is radiating acoustic waves inside the acoustic cavity 110, the control module stores (204) voltage values from the feedback microphone 116R that represent a received signal, corresponding to the driving signal, as detected by the feedback microphone 116R. The control module is then able to compute (206) a correction value (e.g., based on a change in a ratio between a portion of the driving signal and a portion of the received signal) that can be used to modify a gain setting of the feedback microphone 116R (or a gain setting in a signal path that provides a signal derived from the feedback microphone 116R). This procedure 200 may be similar to a calibration procedure that may be performed in the factory using the factory calibration fixture.

Figure 2B:
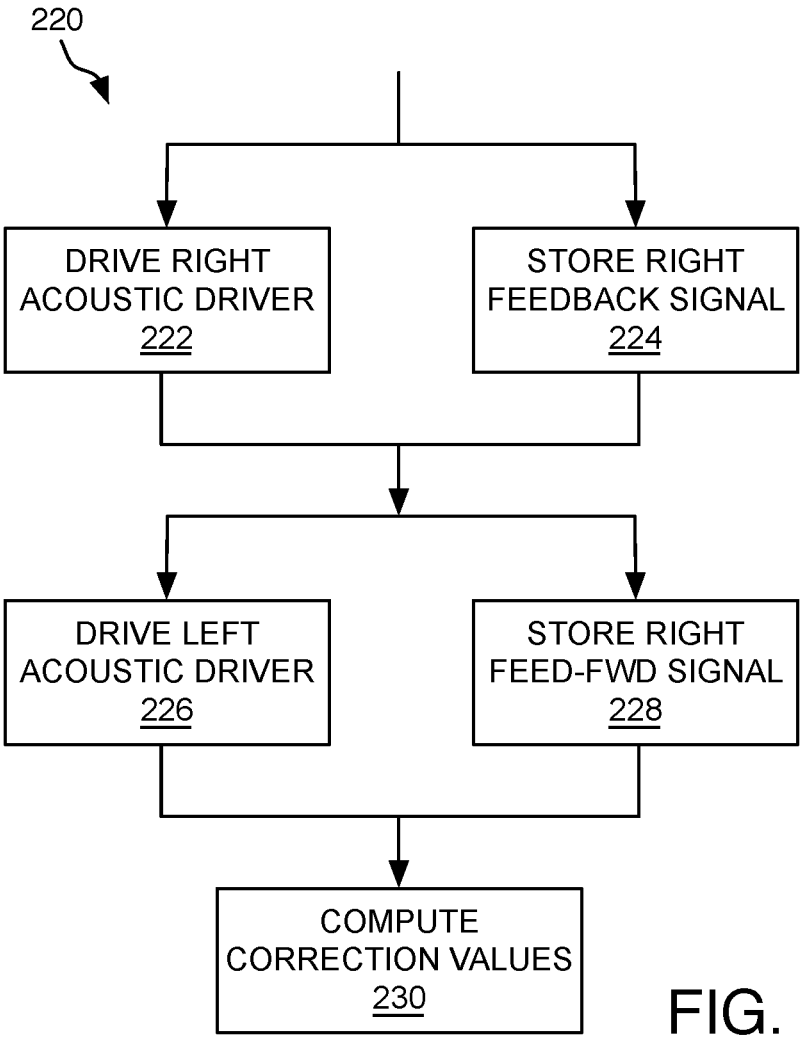

FIG. 2B shows a flowchart for an example procedure 220 for calibrating feedback and feed-forward microphones of an earpiece in a case. In this example, both earpieces are seated within their respective receptacles and both earpieces are used in the procedure 220 to calibrate the feedback microphone and the feedforward microphone of one of the earpieces (e.g., the right earpiece 106R). The control module in the earpiece 106R drives (222) its acoustic driver 114R with a predetermined driving signal. While the acoustic driver 114R is radiating acoustic waves inside the acoustic cavity 110, the control module stores (224) voltage values from the feedback microphone 116R that represent a received signal. After this feedback measurement, the control module in the earpiece 106L drives (226) its acoustic driver 114L with a predetermined driving signal. While the acoustic driver 114L is radiating acoustic waves inside the acoustic cavity 110, the control module stores (228) voltage values from the feed-forward microphone 118R that represent a received signal. In this example, the feed-forward microphone 118R may be acoustically coupled to the acoustic driver 114L through the acoustic passage 124A shown in FIG. 1C. The two acoustic passages 124A and 124B may be formed through a portion of the case 120 such that the passage 124A does not intersect with the acoustic passage 12B. So, in FIG. 1C the passages would not cross because of their paths within a third physical dimension perpendicular to the plane of the cross-section shown in FIG. 1C. The dimensions of the acoustic passages 124A, 124B (e.g., width and/or length) may also be selected appropriately to form an acoustic waveguide that is configured to optimally propagate sound waves generated by the earpieces. The control module is then able to compute (230) a correction value for the feedback microphone 116R and a correction value for the feed-forward microphone 118R. A reason why it may be useful to provide an acoustic wave to the feed-forward microphone from the driver of the other earpiece (instead of the driver of the same earpiece) is to better replicate the dynamics of the ANR under normal use where acoustic noise incident on the feed-forward microphone is independent from any acoustic waves being generated by the driver in the same earpiece as the feed-forward microphone.

Figure 2C:
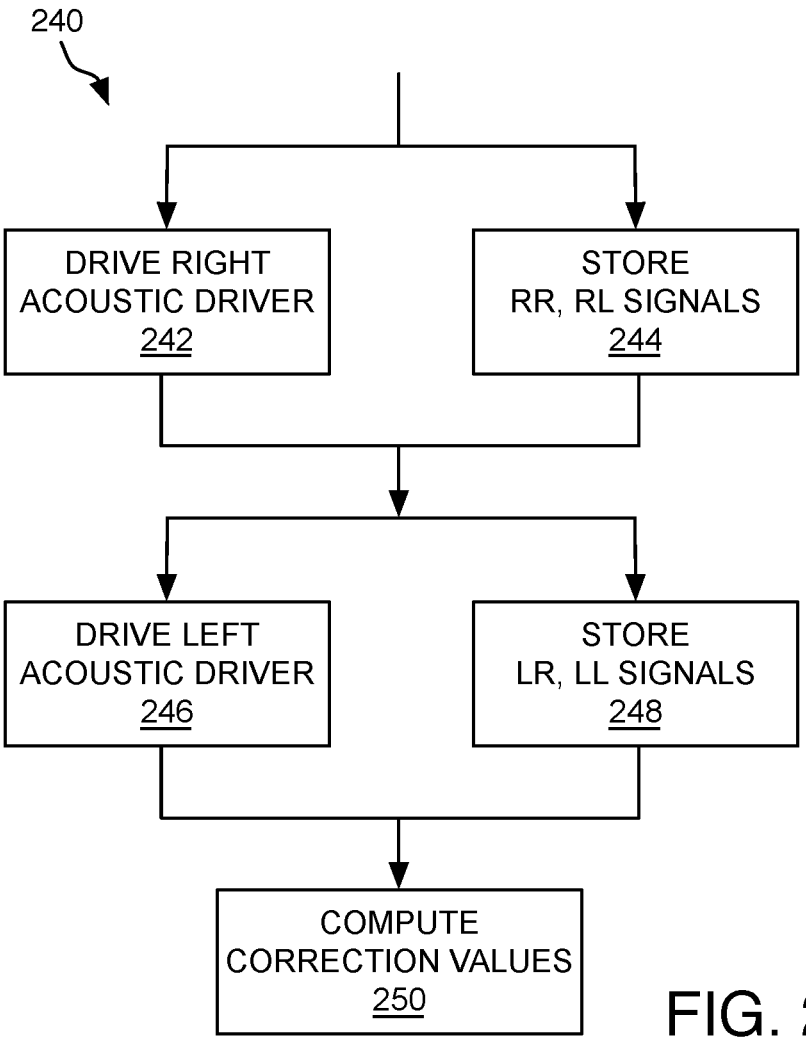

FIG. 2C shows a flowchart for an example procedure 240 for calibrating feedback microphones of two earpieces in a case. In this example, responses to acoustic waves generated by the different drivers in the different earpieces is measured at each of two microphones. A procedure that records received signals at multiple microphones can be useful, for example, to calibrate sensitivities of the acoustic drivers in addition to sensitivities of the microphones. There are four unknown variables in this example (the two sensitivities of the feedback microphones, and the two sensitivities of the acoustic drivers), so the computation for the procedure 240 can be performed using a sufficient number of equations based on measurements from each acoustic driver and equations representing appropriate assumptions, as described in more detail below.

In procedure 240, the control module in the earpiece 106R drives (242) its acoustic driver 114R with a predetermined driving signal. While the acoustic driver 114R is radiating acoustic waves inside the acoustic cavity 110, both control modules store (244) respective voltage values from the feedback microphone 116R that represent a RR received signal, and from the feedback microphone 116L that represent a RL received signal. After these measurements, the control module in the earpiece 106L drives (246) its acoustic driver 114L with a predetermined driving signal. While the acoustic driver 114L is radiating acoustic waves inside the acoustic cavity 110, both control modules store (248) respective voltage values from the feedback microphone 116R that represent a LR received signal, and from the feedback microphone 116L that represent a LL received signal. The control module is then able to compute (250) respective correction values for the feedback microphones 116R, 116L and for the acoustic drivers 114R, 114L. In alternative examples, the feedback microphones of the different earpieces can store received signals sequentially during different instances of the driving signal being played, instead of concurrently during the same instance of the driving signal being played as in the present example.

An example of the computations that can be performed to determine the correction values is provided based on the following example equations. The variables may represent scalar values or vector values, and may represent any of a variety of quantitative measures, such as samples of a frequency response at respective frequencies, which may be computed as a transform of a time-dependent signal. The units of the variables can be chosen appropriately based on the type of physical characteristic being represented (e.g., voltage, pressure). The driving signals of the two acoustic drivers can be given as $d_1$ and $d_2$. The received signals at the two feedback microphones can be given as $s_1$ and $s_2$. There are four correction factors associated with these variables $\Delta s_1$, $\Delta s_2$, $\Delta d_1$, $\Delta d_e$, which can be used to calibrate the various components, where a value of 1.0 for each correction factor represents no change to the nominal calibration. The relationships among these variables corresponding to measurements at the two microphones in response to each of the drivers can be expressed as follows.

$$\begin{bmatrix} s_1 \\ s_2 \end{bmatrix} = \begin{bmatrix} \Delta s_1 G s_1 d_1 \Delta d_1 & \Delta s_1 G s_1 d_2 \Delta d_2 \\ \Delta s_2 G s_2 d_1 \Delta d_1 & \Delta s_2 G s_2 d_2 \Delta d_2 \end{bmatrix} \begin{bmatrix} d_1 \\ d_2 \end{bmatrix}$$

Various assumptions can be made appropriate to the type of calibration being performed. For example, the transfer functions for each driver-to-microphone pathway can be equal and proportional to a common gain value G:

$$Gs_1d_1=Gs_1d_2=Gs_2d_1=Gs_2d_2$$

Another assumption may indicate that a driver input represented by $d_1$ should yield the same response for each of $s_1$ and $s_2$, as follows.

$$\frac{s_1}{\Delta s_1} = Gs_1 d_1 \Delta d_1 d_1 = \frac{s_2}{\Delta s_2}$$

The procedure may set $\Delta s_1=1.0$ and may solve for $\Delta s_2$ as follows:

$$\Delta s_2 = \frac{s_2}{s_1}$$

It can be confirmed using a driver input represented by $d_2$ that this correction results in $s_1=s_2$. So, at this stage of the computation, the microphones are aligned to that they produce the same voltage for a given pressure of an acoustic wave received due to a given driver input.

At a next stage, the acoustic drivers can be aligned to a common target value by using $\Delta d_1$ and $\Delta d_e$. The received microphone value represented by $s_1$ is set to a constant value C, as follows.

$$s_1=Gs_1d_1\Delta d_1d_1=C$$

The procedure may solve for $\Delta d_1$ as follows:

$$\Delta d_1 = \frac{C}{s_1}$$

The received microphone value represented by $s_1$ is set to the constant value C, as follows.

$$s_2=\Delta s_2Gs_2d_2\Delta d_2d_2=C$$

The procedure may solve for $\Delta d_1$ as follows:

$$\Delta d_2 = \frac{C\Delta s_2}{s_2}$$

Using the computed values of each of the variables $\Delta s_1$, $\Delta s_2$, $\Delta d_1$, $\Delta d_2$, the procedure is able to perform calibration that ensures that the audio response is the same in both earpieces and that the loop gain is set appropriately (e.g., according to a target curve).

A variety of other procedures can be used, including calibration procedures that calibrate feedback and feed-forward microphones of both earpieces. A variety of other procedures can be performed to calibrate or tune circuitry of earpieces using an acoustic cavity of a case or other housing for earbuds, headphones, or other kinds of earphones or wearable audio devices. Earpieces can be part of earbuds that use in-ear ANR configurations, or part of headphones that use on-ear or around-ear ANR configurations. Measurements can be frequency-insensitive, or frequency-sensitive. For example, a tuning procedure may be used to provide a driver signal with a predetermined spectrum to an acoustic driver in an earpiece. One or more microphones in the same earpiece, and/or a different earpiece, can provide a detected response signal used to tune a frequency response or other parameters of the earpieces that optimize performance according to a predetermined performance metric.

In some implementations, the procedures can be performed in multiple different configurations of the case or other housing. For example, two different acoustic environments can be provided, one with the cover open, the other with the cover closed. The user can be directed to open or close the cover at the appropriate times so that the procedures can be performed in both configurations. The control module may then be able to use the different measurements from the different configurations to more accurately solve for various calibration or tuning parameters.

Any of the procedures to calibrate or tune circuitry within the earpieces can be performed, for example, after a certain amount of time, each time the earpieces are seated within the case, and/or after a button or switch is used to initiate the procedures. A user could be prompted (e.g., in the graphical user interface) to initiate calibration at regular intervals, or in response to detected performance issues. Or, the case can include a visual indicator, such as an LED light, that prompts a user to initiate calibration. If a significant change in response is detected, the user may be given a prompt to take certain steps to service, repair, or replace an earpiece.

While the disclosure has been described in connection with certain examples, it is to be understood that the disclosure is not to be limited to the disclosed examples but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. An audio system comprising:

a first earpiece comprising at least one acoustic driver, and circuitry that comprises at least one microphone;

a housing configured to receive the first earpiece and enclose around the first earpiece;

an acoustic cavity within the housing configured to provide a predetermined volume that is acoustically coupled to the acoustic driver when the first earpiece is housed within the housing;

wherein the first earpiece or the housing comprises circuitry configured to: (1) measure a response from the microphone to an acoustic wave, and (2) calibrate the circuitry based at least in part on the measured response.

2. The audio system of claim 1, wherein the acoustic wave is provided by the acoustic driver in the first earpiece.

3. The audio system of claim 2, wherein the circuitry comprises active noise reduction circuitry, and the microphone comprises a feedback microphone in a feedback signal path of the active noise reduction circuitry.

4. The audio system of claim 1, further comprising a second earpiece that includes at least one acoustic driver.

5. The audio system of claim 4, wherein the acoustic wave is provided by the acoustic driver in the second earpiece.

6. The audio system of claim 5, wherein the circuitry comprises active noise reduction circuitry, and the microphone comprises a feed-forward microphone in a feed-forward signal path of the active noise reduction circuitry.

7. The audio system of claim 5, wherein the housing is configured to include an acoustic passage that acoustically couples the acoustic driver in the second earpiece to the microphone when the first earpiece and the second earpiece are housed within the housing.

8. The audio system of claim 1, wherein calibrating the circuitry based at least in part on the measured response comprises calibrating a gain associated with the microphone based at least in part on the measured response.

9. The audio system of claim 8, wherein calibrating the gain associated with the microphone comprises calibrating a gain setting in a signal path that provides a signal derived from the microphone.

10. The audio system of claim 1, wherein the housing comprises a case that includes a receptacle configured to receive the first earpiece.

11. The audio system of claim 10, wherein the first earpiece comprises a portion of a wearable audio device, where the earpiece is configured to be placed in, on, around, or in proximity to at least a portion of an ear.

12. The audio system of claim 11, wherein the case comprises charging circuitry that is configured to charge a battery in a portion of the wearable audio device.

13. A method for calibrating wearable audio devices, the method comprising:

providing a first signal to generate a first acoustic wave from an acoustic driver in a first earpiece;

measuring a response from a microphone in a second earpiece to the first acoustic wave;

calibrating circuitry in the first earpiece based at least in part on the measured response from the microphone in the second earpiece;

providing a second signal to generate a second acoustic wave from an acoustic driver in the second earpiece;

measuring a response from a microphone in the first earpiece to the second acoustic wave; and calibrating circuitry in the second earpiece based at least in part on the measured response from the microphone in the first earpiece.

14. The method of claim 13, wherein calibrating the circuitry in the first earpiece comprises calibrating the circuitry in the first earpiece based at least in part on the measured response from the microphone in the second earpiece and based at least in part on the measured response from the microphone in the first earpiece.

15. The method of claim 14, wherein calibrating circuitry in the second earpiece comprises calibrating the circuitry in the second earpiece based at least in part on the measured response from the microphone in the first earpiece and based at least in part on the measured response from the microphone in the second earpiece.

16. A case for a wearable audio device comprising:

a housing configured to receive a first earpiece in a first portion of the housing and configured to receive a second earpiece in a second portion of the housing;

an acoustic cavity within the housing configured to provide a predetermined volume that is acoustically coupled to the first portion of the housing and to the second portion of the housing; and an acoustic passage configured to acoustically couple an acoustic driver in the first earpiece to a microphone in the second earpiece.

17. The case of claim 16, further comprising charging circuitry that is configured to recharge batteries within the first and second earpieces.

18. The case of claim 17, further comprising a battery coupled to the charging circuitry that supplies power to recharge the batteries within the first and second earpieces.

19. The case of claim 16, further comprising an acoustic passage configured to acoustically couple an acoustic driver in the second earpiece to a microphone in the first earpiece.

* * * * *